US007123205B2

(12) United States Patent
Ratajczak et al.

(10) Patent No.: US 7,123,205 B2
(45) Date of Patent: Oct. 17, 2006

(54) CONFIGURABLE OMNIDIRECTIONAL ANTENNA

(75) Inventors: Philippe Ratajczak, Nice (FR); Patrice Brachat, Nice (FR); Pierre-Yves Garel, Nice (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 11/026,450

(22) Filed: Dec. 30, 2004

(65) Prior Publication Data

US 2005/0168391 A1 Aug. 4, 2005

(30) Foreign Application Priority Data

Jan. 2, 2004 (EP) ..... 04300001

(51) Int. Cl.
*H01Q 9/28* (2006.01)

(52) U.S. Cl. ..... 343/773; 343/775

(58) Field of Classification Search ..... 343/773, 343/775

See application file for complete search history.

(56) References Cited

U.S. PATENT DOCUMENTS 3,375,519 A 3/1968 Burnham
4,700,197 A 10/1987 Milne
5,134,420 A * 7/1992 Rosen et al. ..... 343/756
6,268,834 B1 * 7/2001 Josypenko ..... 343/773
6,667,721 B1 * 12/2003 Simonds ..... 343/773

FOREIGN PATENT DOCUMENTS

| | | |
|---|---|---|
| AU | 55 155/80 | 1/1982 |
| DE | 32 37 136 A1 | 4/1984 |
| GB | 1021727 | 3/1966 |

OTHER PUBLICATIONS

J.D. Kraus, "The Biconical Antenna and its Impedance" Chapter 8 of "Antennas", McGraw-Hill, Electrical and Electronic Engineering Series, pp. 217-223, 1950.

Andre De Lustrac, et al., "Numerical and Experimental Demonstration of an Electronically Controllable PBG in the Frequency Range 0 to 20 GHz", Proceedings of the Millennium Conference on Antennas and Propagation Apr. 9-14, 2000, Davos, Switzerland.

* cited by examiner

*Primary Examiner*—Tho Phan
(74) *Attorney, Agent, or Firm*—Cohen, Pontani, Lieberman & Pavane

(57) ABSTRACT

Configurable antenna, adapted to transmit or to receive at least one beam of electromagnetic radiation in a direction and over an angular width that are adjustable. The antenna includes an antenna that is omnidirectional about a given axis z. The omnidirectional antenna comprises at least one biconical antenna and the configurable antenna further comprises controllable reflectivity discrete reflector elements passing through the cones of the omnidirectional antenna without electrical contact and disposed on at least one circle centered on the given axis z. The antenna is applicable to mobile telephony.

13 Claims, 3 Drawing Sheets

Single-beam configuration o non-biased rods
x short-circuited rods multibeam configuration

CONFIGURABLE OMNIDIRECTIONAL ANTENNA

FIELD OF THE INVENTION

The present invention relates to a configurable antenna adapted to transmit or to receive at least one beam of electromagnetic radiation in a direction and over an angular width that are adjustable.

The invention finds one particularly advantageous application in the field of mobile telephones using the GSM (Global System for Mobile communication), DCS (Digital Cellular System), and UMTS (Universal Mobile Communication System) bands, and in the field of broadcasting high-bit-rate WLAN (Wireless Local Area Network), WIFI, LMDS (Local Multipoint Distribution System) and even UWB (Ultra Wide Band) services.

BACKGROUND OF THE INVENTION

The growth of telecommunications systems satisfying mobile communication problems has led carriers and the industry to develop and use base stations that are increasingly complex. At present, constraints related to the number of sites in operation are making it increasingly difficult to continue installing new antennas indefinitely, and it is therefore becoming necessary to use wideband antennas instead of a plurality of single-band antennas or to use the same antenna to cover a plurality of separate areas.

In the field of mobile telephones, cellular coverage may be obtained from single-beam/multibeam antennas whose radiation areas are made adjustable in direction and in angular width by using active elements that control the feed to planar array antennas or focal array reflector antennas for sighting angles of ±30° to ±40°, or are disposed on a cylindrical surface so as to be able to point one or more beams over 360°. There is a direct relationship between the complexity of the feed array and the capabilities and the agility of the antenna, and the complexity increases even faster when forming multiple independent beams. The set of beams must be managed via active radio frequency amplifier, phase shifter, and delay line components operating in the frequency bands of the antenna. These components drastically increase the cost of the antenna or limit its capabilities, if a reasonable cost is to be obtained (for narrow band use, etc.). Moreover, the feeding losses of such active printed array antennas are not negligible and may limit their intrinsic performance.

SUMMARY OF THE INVENTION

One object of the present invention is to provide a configurable antenna that is adapted to transmit or to receive at least one beam of electromagnetic radiation in a direction and over an angular width that are adjustable and that eliminates the limitations of the prior art antenna systems referred to above, in particular by avoiding the use of radio frequency components.

This and other objects are attained in accordance with one aspect of the present invention directed to a configurable antenna, adapted to transmit or to receive at least one beam of electromagnetic radiation in a direction and over an angular width that are adjustable, said antenna comprising an antenna that is omnidirectional about a given axis z, and said omnidirectional antenna comprising at least one biconical antenna, and said configurable antenna further comprising discrete reflector elements of controllable reflectivity passing through the cones of the omnidirectional antenna without electrical contact and disposed on at least one circle centered on the given axis z.

Biconical antennas are omnidirectional antennas having the properties and characteristics described in Chapter 8, "The Biconical Antenna and its Impedance" of "Antennas", J. D. Kraus, McGraw-Hill, Electrical and Electronic Engineering Series, 1950, the content of which is hereby incorporated by reference.

The reflectivity of said discrete reflector elements is advantageously controlled by a direct current (DC) voltage.

Thus, the configurable antenna of the invention modifies the electromagnetic radiation from a wideband or multiband omnidirectional antenna by means of a system of reflectors controlled merely by a DC voltage, in contrast to conventional active antennas in which the radiation is controlled by radio frequency components. In other words, by combining an omnidirectional antenna and a system of discrete reflector elements in accordance with the invention, the omnidirectional coverage of the antenna is transformed into single-beam/multibeam coverage of variable width.

Clearly, the antenna of the invention may be configured as a function of the required coverage to obtain a beam of radiation in a cell of greater or lesser size or to illuminate a plurality of cells in different angular sectors. The coverage may therefore be modified without it being necessary to change the antenna or its position.

In one particular embodiment of the invention, said discrete reflector elements are linear elements, each consisting of discontinuous metal rods interconnected by components whose electrical conductivity is controlled by a DC voltage. These elements were developed by the Institut d'Electronique Fondamentale of l'Université de Paris Sud-Orsay (see "Numerical and Experimental Demonstration of an Electronically Controllable PBG in the Frequency Range 0 to 20 GHz", A. de Lustrac, T. Brillat, F. Gadot and E. Akmansoy, Proceedings of the Antennas and Propagation Conference 2000, 9–14 Apr. 2000, Davos, Switzerland), with the aim of producing a metamaterial with electromagnetic forbidden bands based on the theory of photonic forbidden bands, the spatial distribution of the elements in a biperiodic array creating the equivalent of a "crystal". The effect of this pseudocrystal on the propagation of electromagnetic waves is modified by the presence of defects inside it, which for certain frequency bands makes it possible to obtain transmission across the pseudocrystal, which would have reflected all frequencies if it had been perfect.

For applications of the invention, the working frequencies are below the forbidden bands and the metamaterial is used as a simple controlled metal reflector.

At the practical level, the invention teaches that said controllable electrical conductivity components are diodes or MEMS (MicroElectroMechanical System) micromechanical switches, both of these types of component being controllable by a DC voltage.

As explained in detail below, because said omnidirectional antenna includes a plurality of biconical antennas disposed in an array, it is possible to increase the directionality of the antenna of the invention.

In order to be able to conform the beam of radiation in elevation, i.e. in the plane containing the axis z, in particular to obtain a beam centered on a direction other than 90° to the axis z, the invention provides for said biconical antenna to have asymmetrical cones or to be disposed in an array with a variable phase shift.

Finally, in applications more specific to mobile telephones, it is advantageous if, in accordance with the invention, the discrete reflector elements have a reflectivity that can be varied as a function of the frequency of the electromagnetic radiation. By including defects in the metamaterial consisting of said discrete elements, it is possible to obtain beams of radiation with different coverages for different frequency bands (GSM, UMTS, etc.). Similarly, the invention also envisages the antenna of the invention comprising second discrete reflector elements disposed orthogonally to said discrete reflector elements. This two-fold structure with separate control of horizontal and vertical polarization offers the facility of polarizations at ±45°.

BRIEF DESCRIPTION OF THE DRAWINGS

The following description with reference to the accompanying drawings, which are provided by way of non-limiting example, explains clearly in what the invention consists and how it may be reduced to practice.

DETAILED DESCRIPTION OF THE DRAWINGS

Figure 1:
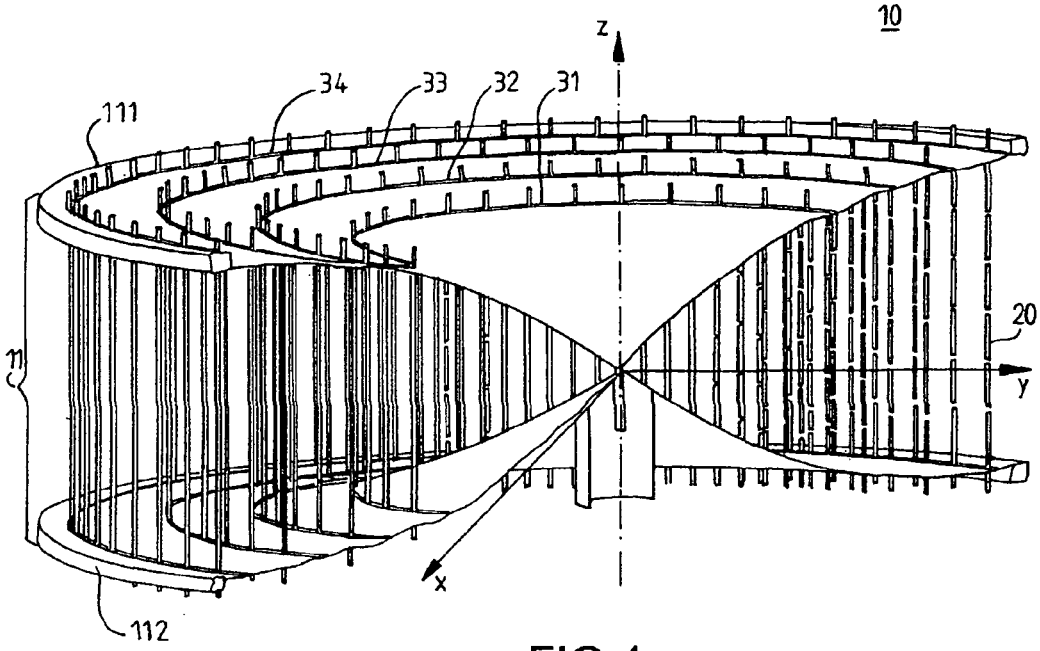
FIG. 1 is a perspective view of a configurable antenna of the invention.
Figure 2:
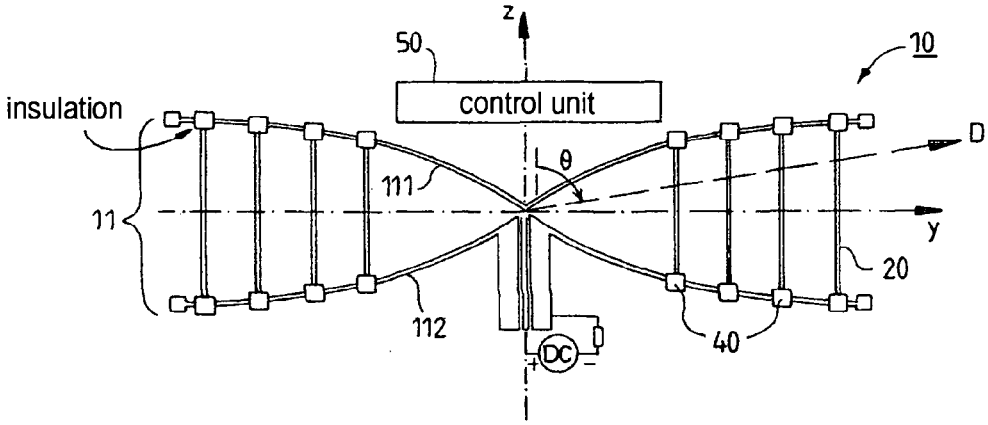
FIG. 2 is a view of the FIG. 1 antenna in section taken along the axis z.

FIGS. 1 and 2 show a configurable antenna 10 comprising a wideband or a multiband omnidirectional antenna 11 which is of the biconical type in the example shown in these figures. In accordance with the general principle of biconical antennas explained in the book by J. D. Kraus referred to above, the omnidirectional antenna 11 comprises two substantially conical surfaces 111 and 112 disposed back to back with a common axis z that is also the axis of the antenna 10. The antenna 11 is adapted to transmit or to receive a beam of electromagnetic radiation omnidirectionally, i.e. isotropically around the axis z, which constitutes an axis of revolution of the antenna 11. If the two cones 111 and 112 are symmetrical, as shown in FIGS. 1 and 2, the maximum directionality is obtained for a radiation direction D at an angle θ of 90° to the axis z, i.e. in the plane xy.

In order to configure the antenna 10 as a single-beam/multibeam antenna with direction and angular beam width that are adjustable, the omnidirectional antenna 11 is associated with a system of discrete reflector elements 20 of controllable reflectivity disposed in at least one circle centered on the axis z. As shown in FIG. 1 and in more detail in FIGS. 4*a* to 4*c*, said reflector elements 20 are disposed in four concentric circles 31, 32, 33, 34.

Figure 3A:
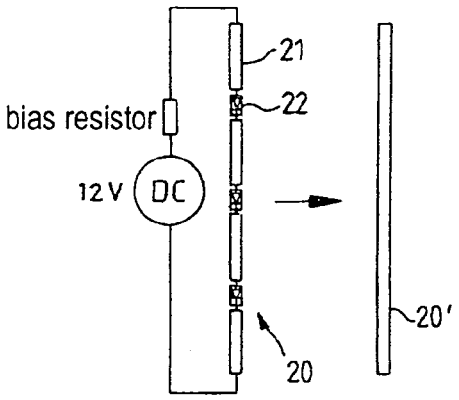
FIG. 3*a* represents a reflector element when biased.
Figure 3B:
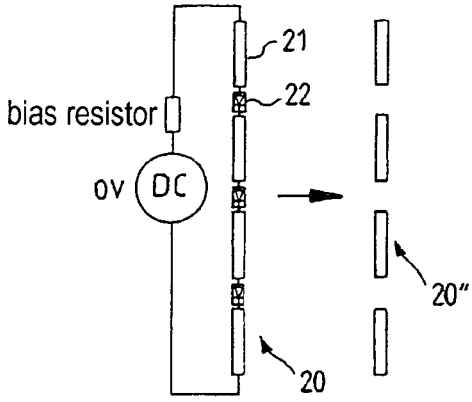
FIG. 3*b* represents the FIG. 3*a* reflector element when not biased.

In the embodiments shown in FIGS. 3*a* and 3*b*, the reflector elements 20 are linear elements each comprising discontinuous metal rods 21 interconnected by components 22 of controllable electrical conductivity. The components 22 shown in FIGS. 3*a* and 3*b* are diodes controlled by a DC voltage. The system formed by a regular set of discrete linear elements 20 of this type constitutes a metamaterial with electromagnetic forbidden bands, the properties of which are outlined above with reference to the paper by A. de Lustrac et al.

FIGS. 3*a* and 3*b* show how the linear elements 20 function when applied to the configurable antenna 10.

In FIG. 3*a*, the diodes 22 are biased by a DC voltage and, because of their very low electrical resistance, produce the equivalent of a single rod of greater length than each individual rod 21. This rod, identified under these conditions by the reference number 20', is an electromagnetic reflector. It is clear that the spatial distribution of the linear elements 20' of the rods 21 that are short circuited forms a reflector for distributing the radiation in space at will.

In FIG. 3*b*, the diodes are not biased and therefore have very high impedance. There is no electrical connection between the rods, and the equivalent rod 20' is transparent to electromagnetic waves. In practice, to limit the perturbation caused by the rods 21, it is advantageous if the length of an individual rod 21 is shorter than one fifth of the shortest wavelength.

The advantage of using this system of controlled reflector elements results mainly from the fact that the diodes are biased by a DC voltage. There is therefore no complex RF amplifier or phase shifter component. To obtain the best possible short circuit, the diode 22 must merely be selected to have the lowest possible internal resistance at the intended frequencies when it is biased.

Of course, other components 22 whose electrical conductivity may be controlled by a DC voltage may be envisaged, such as the MEMS micromechanical switches referred to above.

For the application to the invention, the configurable reflector system associated with the omnidirectional antenna 11 comprises a plurality of circles concentric with the axis z and in which the reflector elements 20 are regularly distributed with a constant linear pitch δ.

Figure 4A:
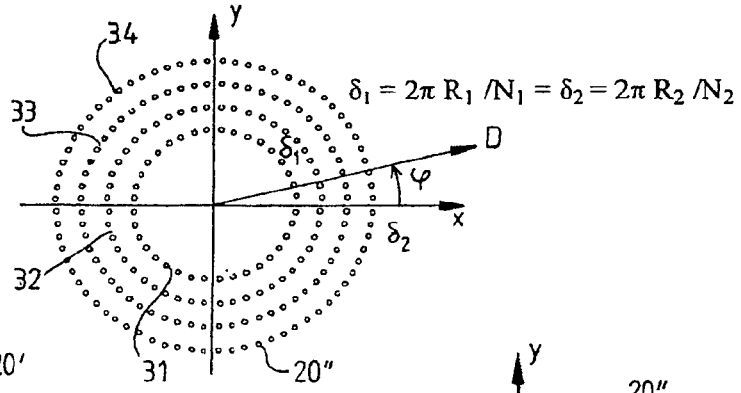
FIG. 4*a* is a plan view of one particular distribution of non-biased reflector elements.
Figure 4B:
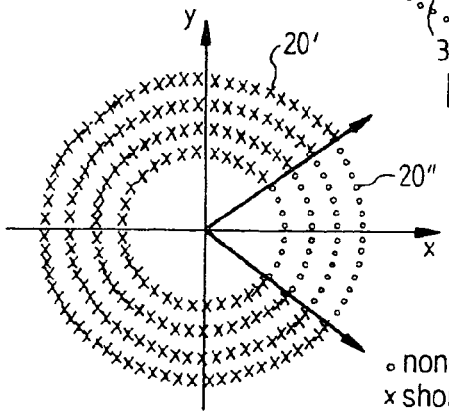
FIG. 4*b* shows the FIG. 4*a* distribution with the reflector elements in a single-beam bias configuration.
Figure 4C:
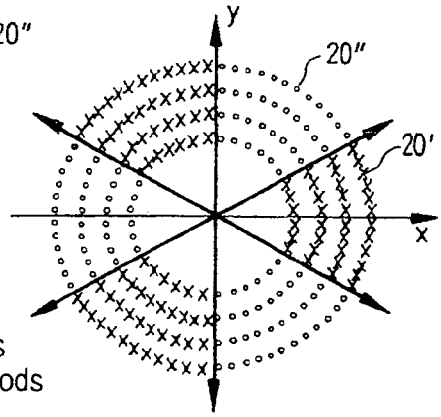
FIG. 4*c* shows the FIG. 4*a* distribution with the reflector elements in a multibeam bias configuration.

As shown in FIG. 4*a*, in order to obtain a constant linear pitch δ for all the circles 31, 32, 33, 34, the angular distribution of the elements 20 varies as a function of the radius of the circle concerned.

The number of concentric circles of reflector elements 20 is fixed in order to have sufficient attenuation in the short circuit area, since the metal rod 20' is a localized element and the superposition of concentric layers provides the best possible simulation of a cylindrical metal reflector. Similarly, the radial spacing between the concentric circles must be relatively small for the repetition of the circles to generate a cylindrical reflective portion.

To obtain a maximum dimension compatible with the intended application, a compromise must be made between the number of circles, the spacing between the circles, and the total overall size of the antenna 10.

The required distribution of the electromagnetic radiation beam may be obtained depending on whether the linear elements 20 are biased or not, for example an omnidirectional distribution (FIG. 4*a*), a variable-width single-beam distribution (FIG. 4*b*), or a multibeam distribution (FIG. 4*c*) in which each beam is of variable width.

Note that it is possible to tune the antenna 10 to free space optimally by acting on the bias configuration of the linear elements of the first concentric circle 31. For example, to obtain an effective aperture angle of 60°, it is necessary for the elements 20' of the first circle 31 to be open circuit over a wider angle.

FIG. 2 shows that each linear element 20 passes through the upper metal cone 111 and the lower metal cone 112 without electrical contact, by virtue of passing through insulating passages 40. Because of the coaxial feed to the biconical antenna 11, it is a very simple matter to apply a DC voltage to the upper cone 111 in order to be able to bias each linear element 20 independently by means of a control unit 50 placed either on the upper cone 111, in which case the elements 20 are grounded on the lower cone 112 (FIG. 2), or under the lower cone 112, in which case the elements 20 are connected directly to the upper cone 111 for the connection to the positive voltage.

The surfaces 111 and 112 are not strictly conical, but have a pseudoconical shape adapted to the need to make a mechanical connection between the linear elements 20 and the cones of the biconical antenna 11, in addition to the insulating passages 40.

Figure 5:
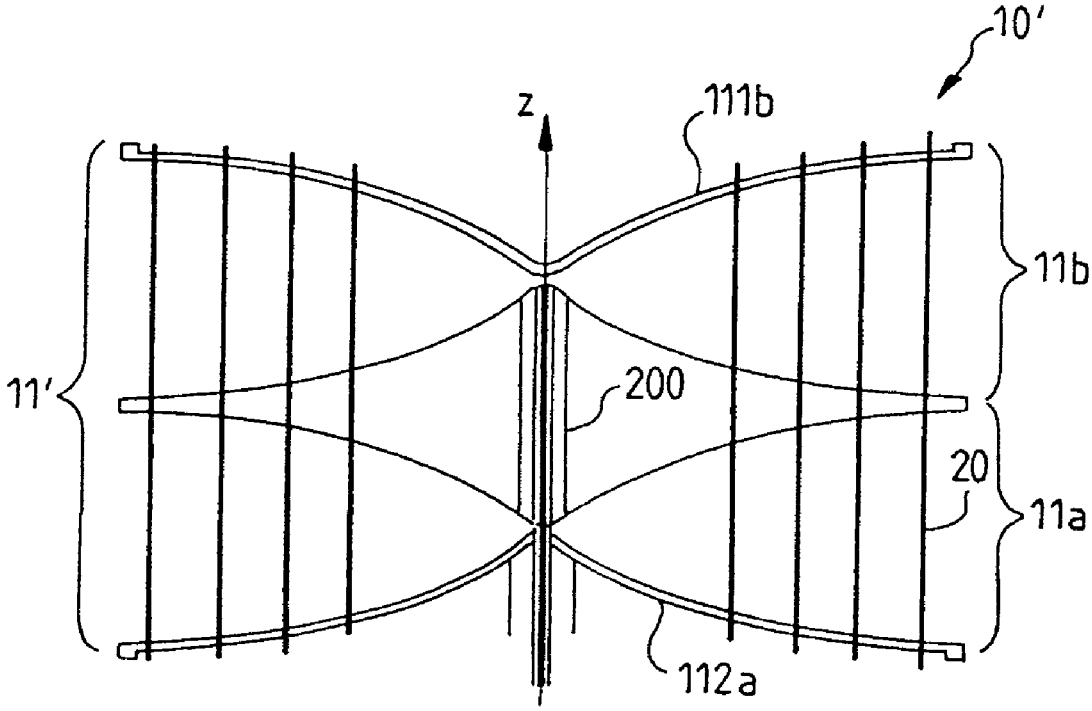
FIG. 5 is a view in section in a plane containing the axis z, showing two antennas of the invention disposed in an array.

The vertical array of antennas 10 of the invention shown in the figures described above is of great benefit for increasing the vertical directionality of the radiating structure. FIG. 5 shows a configurable antenna 10' consisting of an omnidirectional antenna 11' comprising two biconical antennas 11*a* and 11*b*. The short circuit or open circuit configuration of the linear reflector elements 20 is the same for both biconical antennas 11*a* and 11*b*, in order to generate the azimuth coverage(s). The two half-antennas are fed in series, and the spacing between the two biconical antennas 11*a* and 11*b* resynchronizes the phases of their respective feeds to obtain optimum radiation at $\theta=90°$, as explained above, for the specific application to mobile telephones, for example, and to match the series connection of the antennas 11*a* and 11*b* progressively.

The controlled linear elements 20 are integrated in the same way as in a simple biconical antenna. The bias voltage of the diodes is applied to the central core of the coaxial cable 200 and recovered at the final cone 111*b* of the array. The elements 20 pass through the cones without electrical contact and are grounded via the lower cone 112*a*.

To produce a beam of radiation in a direction other than that defined by $\theta=90°$, a variable phase shift may be applied between the various biconical antennas formed into an array in a configurable multiple antenna. The same result may be obtained with a configurable multiple antenna using an array of asymmetrical biconical antennas.

It should be pointed out that with reflector elements 20 having reflectivity that is variable as a function of frequency, it is possible to generate beams in certain directions in space for a given frequency band and in other directions for other frequency bands.

Finally, note the possibility of obtaining double vertical and horizontal polarization by integrating into the system of vertical reflector elements 20 another structure of orthogonal reflector elements to control the horizontal radiation and thereby obtain radiation at ±45°.

We claim:

1. A configurable antenna, adapted to transmit or to receive electromagnetic radiation in a direction and over an angular width that are adjustable, said antenna comprising:

an antenna that is omnidirectional about a given axis z, and said omnidirectional antenna comprising at least one biconical antenna; and discrete reflector elements of controllable reflectivity passing through cones of the omnidirectional antenna without electrical contact and disposed on at least one circle centered on the given axis z, wherein said reflectivity of each discrete reflector element is controlled such that said configurable antenna transmits or reflects a multibeam distribution of said electromagnetic radiation.

2. An antenna according to claim 1, wherein the reflectivity of said discrete reflector elements is controlled by a DC voltage.

3. An antenna according to claim 2, wherein said discrete reflector elements are linear elements each comprising discontinuous metal rods interconnected by components whose electrical conductivity is controllable by a DC voltage.

4. An antenna according to claim 3, wherein said controllable electrical conductivity components are diodes.

5. An antenna according to claim 3, wherein said controllable electrical conductivity components are micromechanical switches.

6. An antenna according to claim 1, wherein said discrete reflector elements are distributed with a constant linear pitch in a plurality of circles concentric with the axis z.

7. An antenna according to claim 6, wherein said constant linear pitch is identical for all the concentric circles.

8. An antenna according to claim 1, wherein the length of the reflector elements is shorter than one fifth of the shortest electromagnetic radiation wavelength.

9. An antenna according to claim 1, wherein said biconical antenna has asymmetrical cones.

10. An antenna according to claim 1, wherein said omnidirectional antenna comprises a plurality of biconical antennas disposed in an array.

11. An antenna according to claim 10, wherein said biconical antennas are disposed in an array with a variable phase shift.

12. An antenna according to claim 1, wherein the discrete reflector elements have a reflectivity that is variable as a function of the frequency of the electromagnetic radiation.

13. An antenna according to claim 1, further comprising second discrete reflector elements disposed orthogonally to said discrete reflector elements.

* * * * *